US006965069B2

(12) United States Patent
Le-Faucheur et al.

(10) Patent No.: US 6,965,069 B2
(45) Date of Patent: Nov. 15, 2005

(54) PROGRAMMABLE MELODY GENERATOR

(75) Inventors: Laurent Le-Faucheur, Juan-les-pins (FR); Gilles Dassot, Biot (FR)

(73) Assignee: Texas Instrument Incorporated, Dallas, TX (US)

( * ) Notice: Subject to any disclaimer, the term of this patent is extended or adjusted under 35 U.S.C. 154(b) by 805 days.

(21) Appl. No.: 09/965,141

(22) Filed: Sep. 26, 2001

(65) Prior Publication Data

US 2002/0177997 A1 Nov. 28, 2002

(30) Foreign Application Priority Data

May 28, 2001 (EP) ..... 01401385

(51) Int. Cl.[7] ..... G10H 7/08
(52) U.S. Cl. ..... 84/659; 84/622
(58) Field of Search ..... 84/603–607, 622–625, 84/659–661; 381/118; 704/208

(56) References Cited

U.S. PATENT DOCUMENTS 4,715,257 A 12/1987 Endo et al.
5,086,475 A * 2/1992 Kutaragi et al. ..... 704/265
5,329,062 A * 7/1994 Kaneko ..... 84/603
5,347,478 A * 9/1994 Suzuki et al. ..... 708/203
5,567,901 A 10/1996 Roden et al.
5,744,739 A * 4/1998 Jenkins ..... 84/603
5,774,855 A 6/1998 Foti et al.
5,814,750 A * 9/1998 Wang et al. ..... 84/602
5,828,994 A 10/1998 Covell et al.
5,864,812 A 1/1999 Kamai et al.
5,970,453 A 10/1999 Sharman
5,987,413 A 11/1999 Dutoit et al.
6,025,553 A * 2/2000 Lee ..... 84/610
6,124,542 A 9/2000 Wang
6,125,344 A 9/2000 Kang et al.

* cited by examiner

*Primary Examiner*—Marlon T. Fletcher
*Assistant Examiner*—David S. Warren
(74) *Attorney, Agent, or Firm*—Robert D. Marshall, Jr.; W. James Brady, III; Frederick J. Telecky, Jr.

(57) ABSTRACT

A digital system and method of operation is provided in which musical notes and melodies are synthesized. The operation done for music synthesis is based on time domain processing of prerecorded waveforms, referred to as analysis waveforms. The computations are done using time-marks, which is a set of digital sample positions of the analysis waveform indicating the starting position of each period of the fundamental frequency or an arbitrary position for non-periodic analysis waveforms. The algorithm defines on a time scale the time-marks of the synthesis waveform. The synthesis is based on making a relation between the analysis time-marks and the synthesis time-marks. The synthesis waveforms are built with the extraction of small portions of signal located at corresponding time-mark positions of the analysis waveform and adding them to the corresponding synthesis time-marks on the synthesis time-scale. This extraction is done with the multiplication of a windowing pattern, such as a cosinous Hanning window, to the analysis samples.

6 Claims, 6 Drawing Sheets

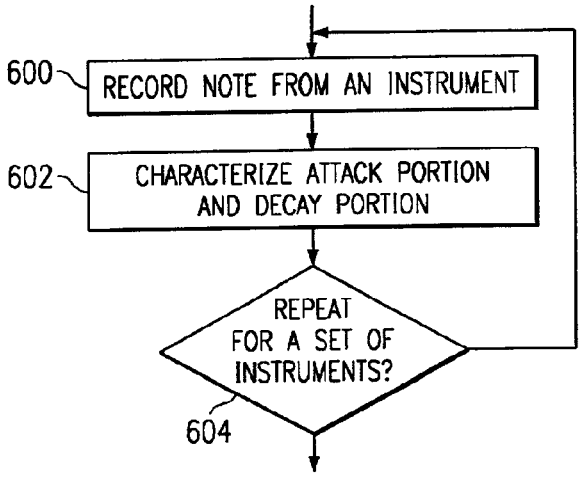
*FIG. 6A*
| | | |
|---|---|---|
| | PIANO | 500<br>2000 |
| 620 | BASS | 500<br>x |
| | DRUM | 500<br>2000 |
| 622 | FLUTE | x<br>2000 |
| | HORN 1 | 500<br>2000 |
| | HORN 2 | 500<br>2000 |
| | STRING 1 | 500<br>2000 |
| | STRING 2 | 500<br>2000 |
*FIG. 6B*
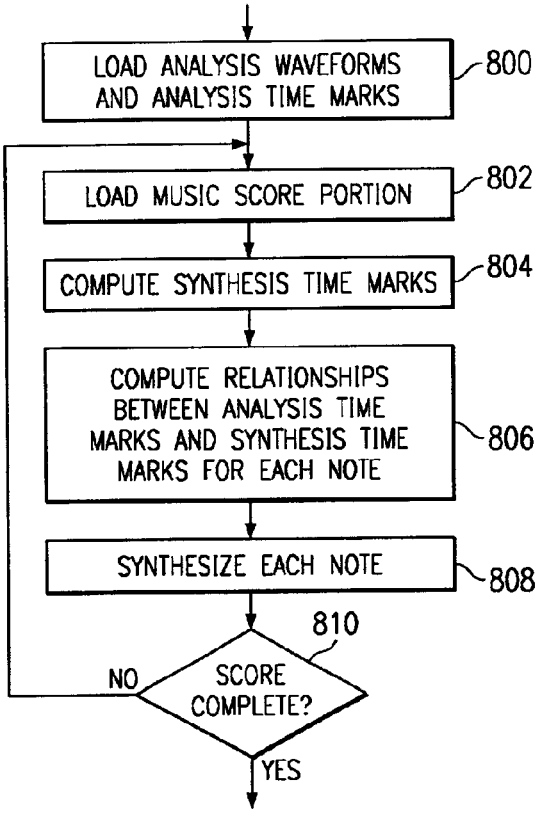
*FIG. 8*

PROGRAMMABLE MELODY GENERATOR

This application claims priority to European Application Serial No. 01401385.8, filed May 28, 2001 (TI-32357EU).

FIELD OF THE INVENTION

This invention generally relates to synthesis of musical sounds.

BACKGROUND

The synthesis of musical notes and melodies from a stored data representation is commonly used in a variety of digital systems, such as: instrumental keyboards, toys, games, computers, and wireless communication devices. One method of digitally representing musical notes is the Musical Instrument Digital Interface (MIDI) and is a standard for communicating between keyboards, soundcards, sequencers, effects units, and many other devices, most of which are related to audio or video. A synthesizer generates musical tones in response to a MIDI file by controlling a bank of tone generators. The tone generators may be discrete oscillators or simulated electronically, often by using a digital signal processor with spectrum models for tone restitution. Another way of making synthetic music is by using samples recorded from actual instruments.

Many different types of processors are known, of which microprocessors are but one example. For example, Digital Signal Processors (DSPs) are widely used, in particular for specific applications, such as mobile processing applications. DSPs are typically configured to optimize the performance of the applications concerned and to achieve this they employ more specialized execution units and instruction sets. Particularly in applications such as mobile telecommunications, but not exclusively, it is desirable to provide ever increasing DSP performance while keeping power consumption as low as possible.

To further improve performance of a digital system, two or more processors can be interconnected. For example, a DSP may be interconnected with a general purpose processor in a digital system. The DSP performs numeric intensive signal processing algorithms while the general purpose processor manages overall control flow. The two processors communicate and transfer data for signal processing via shared memory.

Particularly in portable equipment such as wireless digital assistant devices, minimizing power consumption is important. Accordingly, there is needed a system and method for synthesizing quality musical tones that is computationally efficient.

SUMMARY OF THE INVENTION

Particular and preferred aspects of the invention are set out in the accompanying independent and dependent claims. In accordance with a first embodiment of the invention, a method is provided for synthesizing music in a digital system. An analysis digital waveform is first accessed that has duration, a pitch, an attack portion and a decay portion. The duration and pitch for a note to be synthesized is determined. A set of timing marks for the analysis waveform is determined such that the timing marks correspond to periodicity of the analysis digital waveform. A second set of timing marks is computed for the synthesis waveform such that the second timing marks correspond to periodicity of the synthesis waveform. Samples are calculated for each period defined by adjacent timing marks using samples selected from a corresponding period in the analysis waveform defined by adjacent timing marks to form the synthesized digital waveform.

In a first embodiment, the samples are calculated by first calculating a set of samples for a period m using a first cosinous window, then calculating a set of samples for a period m−1 using a second cosinous window; and then combining the set of samples for period m and the set of samples for period m−1 using a weighting function.

In another embodiment, samples are calculated by occasionally reversing a selected one of the set of samples before the step of combining the sets of samples.

In another embodiment, an analysis waveform is used to synthesize a range of at least two octaves for an instrument.

Another embodiment of the invention is a digital system that has a memory for holding a plurality of instrumentally correct digital waveforms corresponding to a plurality of instruments. There is a first processor connected to the memory and the first processor is operable to store a musical score in the memory. There is a second processor connected to the memory and the second processor is operable to synthesize a melody signal in response to the musical score using the method described above. There is also an audio device connected to the second processor for playing the synthesized melody signal.

BRIEF DESCRIPTION OF THE DRAWINGS

Particular embodiments in accordance with the invention will now be described, by way of example only, and with reference to the accompanying drawings in which like reference signs are used to denote like parts and in which:

FIG. 6A is a flow diagram illustrating how a set of analysis waveforms are collected;

FIG. 6B is an illustration of a set of analysis waveforms for several different instruments;

FIG. 8 is a flow chart illustrating synthesis of a melody on the digital system of FIG. 7 according to an aspect of the present invention.

Corresponding numerals and symbols in the different figures and tables refer to corresponding parts unless otherwise indicated.

DETAILED DESCRIPTION OF EMBODIMENTS OF THE INVENTION

Previous solutions for synthesizing music have used large memory sizes or high processing rates to produce good quality synthesized music. When processing rate is optimized, large over-sampled memory arrays are used to store multiple sound samples. When memory size is optimized, then complex digital filtering and interpolation schemes are used which require high processing rates. In many cases, the synthesized sound is degraded due to digital down-sampling. The sound spectrum is shifted in order to reach a targeted sound pitch. The resulting sound tone is then disturbed because the short-term spectrum is also shifted.

A method for synthesizing music has now been discovered that solves the tradeoff between large memory or high processing loads. This method generates the correct pitch with half-tone precision using prerecorded samples that do not have the same pitch. This operation is done with only a few arithmetic operations per digital sample and using a small data buffer size in order to let the music be played on low power portable devices, such as a wireless telephone. The novel methods that will now be described make use of a mathematical technique similar to one described in a paper entitled "Time-Frequency Representation of Digital Signals and Systems Based on Short-Time Fourier Analysis" by Michael Portnoff, IEEE Transaction on Acoustics, Speech, and Signal Processing, Vol. ASSP-28, No 1 Feb. 1980, and is incorporated herein by reference.

Figure 1:
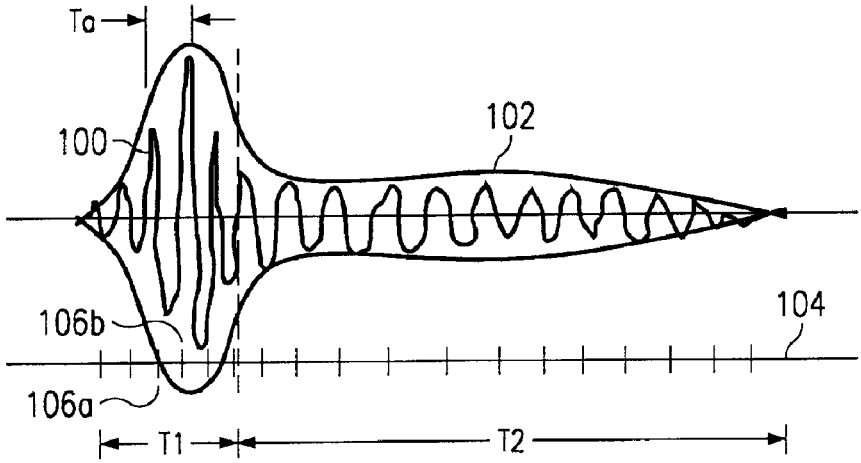
FIG. 1 is a representative waveform illustrating an attack portion and a decay portion.

FIG. 1 is a representative waveform illustrating an attack portion and a decay portion of an instrumentally correct digital waveform 100, according to an aspect of the present invention. This waveform is a digitally sampled waveform of a single note struck on a musical instrument, such as a piano. The current embodiment of the invention is concerned with wireless telephony, in which the bandwidth of the sound reproducing system is generally limited to approximately four kilohertz, therefore a sampling rate of eight kilohertz is used. The following descriptions all assume this sample rate, however, it should be understood that the invention is equally useful for higher quality sound synthesis systems. In such systems, the sample waveforms would typically be sampled at higher rates, such as twenty kilohertz or higher, for example.

Digital waveform 100 is a single periodic note. The duration of the period is the inverse of the fundamental frequency and is denoted as Ta. Waveform 100 has a fundamental frequency of 500 hertz, therefore its period Ta is 2 ms and each period is sampled approximately sixteen times (8000/500).

Time line 104 provides a time references for the following description. A set of timing marks, represented by 106*a, b*, are marked on time line 104 and correspond to period boundaries of waveform 100. Thus, for waveform 100 each period Ta bounded by adjacent timing marks 106*a*, 106*b* includes sixteen digital samples. For a non-periodic waveform, timing marks can be assigned at regular intervals.

A first portion of digital waveform 100 that includes a set of timing marks denoted as T1 is referred to as the attack portion. This corresponds to the initial sound produced by a stringed instrument when a string is hit or plucked, or by percussion instrument when struck, or by a wind instrument when a note is sounded. Typically, the attack portion builds up to crescendo and then subsides. A second portion of digital waveform 100 that includes a set of timing marks denoted as T2 is referred to as the decay portion. During the decay portion, the string vibration slowly dies out or is damped, the percussion vibration slowly dies out or the wind tapers off.

The relative duration of the T1 phase and the T2 phase depends on the type of instrument. For example, a flute generally produces a strong short attack with a relatively long decay, while a piano produces relatively long attack phases and shorter decay phases. For lower notes produced by longer strings, the decay is longer due to the longer string, resonance, etc. Advantageously, by using instrumentally correct recordings from actual instruments, this embodiment of the invention captures nuances of the musical instrument, such as reverberation, damping, etc. Therefore, melodies can be synthesized that recreate the tonal characteristics of the original instruments.

Because of the variation in attack phase and decay phase relative duration times, each digital waveform is visually inspected by displaying the waveform on a display device. A boundary between T1 and T2 is then selected based on the inspection and included with the digital file. The set of timing marks are also included with the digital file associated with digital waveform 100.

Referring still to FIG. 1, envelope 102 is representative of waveform 100 and will be used for clarity in the following description.

Figure 2A:
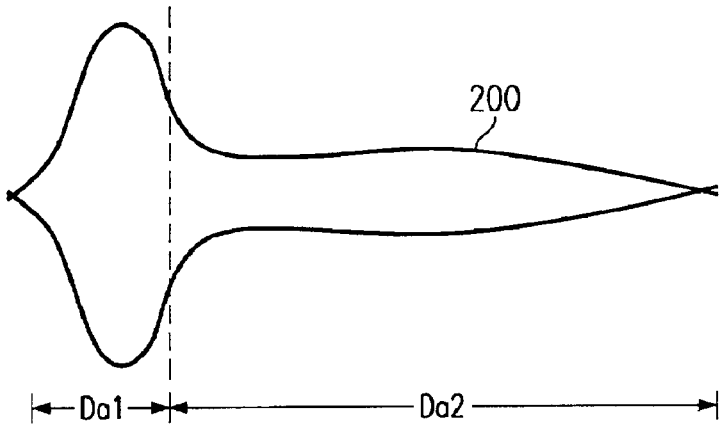
FIG. 2A is an illustration of an analysis waveform envelope of a sample music note of FIG. 1 that will form the basis of music notes synthesized according to aspects of the present invention.

FIG. 2A is an illustration of an analysis waveform envelope 200 of a sample music note representative of waveform 100 of FIG. 1 that will form the basis of music notes synthesized according to aspects of the present invention. Waveform 200 is referred to as an analysis waveform because it encapsulates an analysis of the original recorded note. Waveform 200 has an attack phase duration Da1 and a decay phase duration of Da2. The attack phase includes a set of timing marks T1 named T1[i], the number of time-marks in T1 is named Na1. The decay phase includes a set of timing marks T2 named T2[i], the number of time-marks in T1 is named Na2.

Figure 2B:
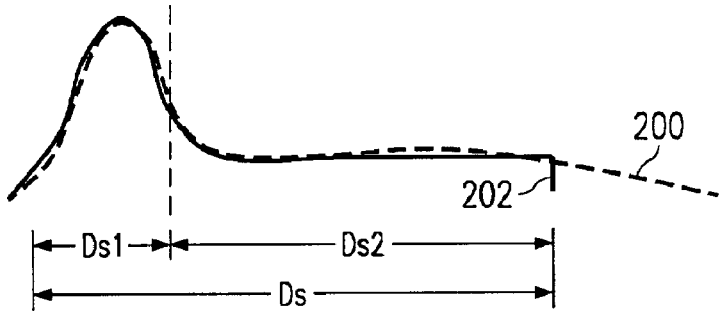
FIG. 2B is an illustration of a synthesis waveform envelope of a synthesized music note having a shorter duration than the analysis waveform of FIG. 2A.

FIG. 2B is an illustration of a synthesis waveform envelope 202 of a synthesized music note having a different pitch and a shorter duration than analysis waveform 200 of FIG. 2A. Note, only the upper half of the waveform is shown, for simplicity. Synthesized waveform 202 has a total duration Ds. According to an aspect of the invention, an attack phase duration Ds1 is approximately equal in length to Da1. A decay phase is then formed having a duration Ds2=Ds−Ds1. It has now been determined by the present inventor that the ear is very sensitive to the attack phase, in which a transition from silence to the initial note is made. Therefore, maintaining instrumentally correct aspects of the attack phase while varying the pitch is critical for realistic synthesis.

When the duration of the synthesized tone is shorter than the analysis tone, there will be relation processing referred to as type-A on analysis time-marks indexes up to the one corresponding to a sample position equal to the last sample position of the synthesis.

Figure 2C:
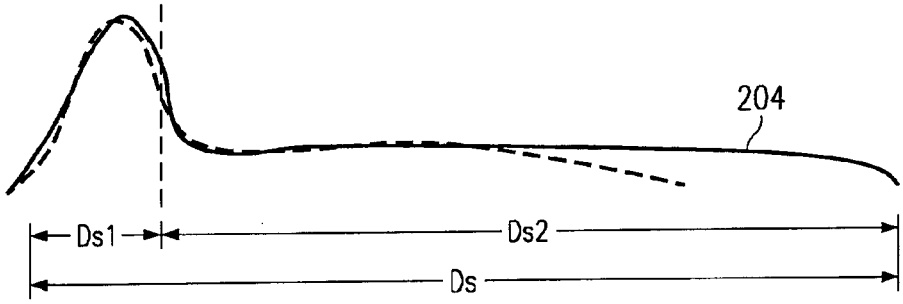
FIG. 2C is an illustration of a synthesis waveform envelope of a synthesized music note having a longer duration than the analysis waveform of FIG. 2A.

FIG. 2C is an illustration of a synthesis waveform envelope 204 of a synthesized music note having a different pitch and a longer duration than analysis waveform 200 of FIG. 2A. Synthesized waveform 204 has a total duration Ds. Again, according to an aspect of the invention, an attack phase duration Ds1 is formed to be approximately equal in length to Da1 even though the pitch is different. A decay phase is then formed having a duration Ds2=Ds−Ds1.

When the duration of the synthesized tone is greater than the analysis tone, then there will be relation processing type-A on the Na1 time-marks T1[i] and a relation processing type-B on the Na2 time-marks T2[i]. The duration of (Ds−Ds1) is named Ds2 and corresponds to the end of the synthesis part of the waveform.

For type-A, the computation consists of a pitch modification of the analysis waveform. For type-B, the computation consists of a pitch modification and a duration extension to be applied only on the T2 time-marks in the decay portion of the analysis waveform. This is referred to as "time warping" because the decay portion of the analysis waveform is stretched out to match the duration of the synthesized waveform.

Figure 2D:
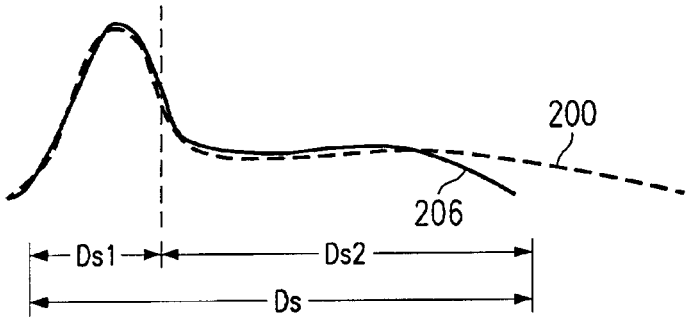
FIG. 2D is an illustration of an alternative method that can be used when the duration of the synthesized tone is shorter than the analysis tone.

FIG. 2D illustrates an alternative method that can be used when the duration of the synthesized tone is shorter than the analysis tone, as was discussed with reference to FIG. 2B. In this case, type B processing is used for the decay portion in order to time warp the decay portion and synthesize a gradual decay rather than an abrupt end as was illustrated in FIG. 2B.

Figure 3:
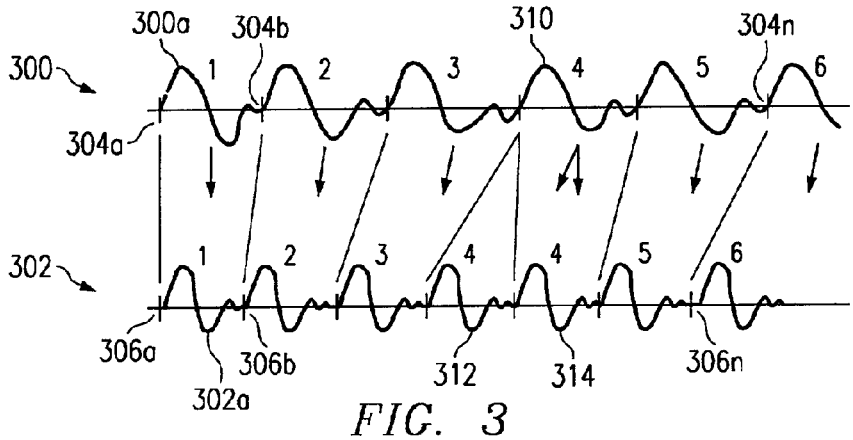
FIG. 3 is an illustration of a higher pitched note that is synthesized from a lower pitched analysis waveform, illustrating replication of an analysis period, according to an aspect of the present invention.

FIG. 3 is an illustration of a higher pitched note that is synthesized from a lower pitched analysis waveform, illustrating replication of an analysis period, according to an aspect of the present invention. Analysis waveform 300 has timing marks 304*a–n* computed that coincide with each period, such as period 300*a*. The timing marks are used as indexes during the synthesis calculations, which will be described in more detail later. Synthesis waveform 302 has a set of timing marks 306*a–n* computed to correspond to the periods that are to be synthesized, such as 302*a*. For each period, samples are selected from the closest time-line wise corresponding analysis period. For example, for synthesis period 302*a*, samples are selected from corresponding analysis period 300*a*.

Since the pitch of synthesis waveform 302 is higher than analysis waveform 300, a time skew develops. In order to compensate for this time skew, two synthesis periods 312, 314 are formed by selecting samples from the same analysis period 310 whenever the time skew become approximately one period in length.

In a similar manner, if the pitch of a synthesis waveform is lower than analysis waveform 300, a time skew also develops. In this case, an analysis period is skipped whenever the time skew become approximately one period in length.

The relation between the analysis time-mark index and the synthesis time-mark index is a multiplication factor. The analysis time-mark index has a value ranging from 0 to Na−1, where Na=total number of analysis time-marks. The synthesis time-mark index has a value ranging from 0 to Ns−1, where Ns=total number of synthesis time-marks. If Is is the current synthesis time-mark index and Ia is the current analysis time-mark index, the synthesis will is based on waveform extraction of the corresponding analysis waveform located on the time-marks Ia=Is*Ks, where Ks is a fractional factor and the multiplication must be rounded in order give an integer index value for Ia.

For Type-A relation processing, Ks is computed as follows:

$$Ks=Ts/Ta$$

Type-B relation processing, Ks is computed as follows:

$$Ks=(Ts*Da2)/(Ta*Ds2)$$

For example, assume an analysis waveform recorded at an 8000 Hz sample rate, the pitch of which is 500 Hz and the duration is 50 ms. The attack portion of the waveform is determined to be approximately the first 20 ms, therefore the T1 time-mark set is computed and corresponds to 20 ms of the beginning of the waveform. Accordingly, the T2 time-mark set corresponds to the decay portion of the waveform, which in this case includes time-marks in the set [20 ms . . . 50 ms]. The analysis time-marks are spaced such that each period includes sixteen samples, since (8000 Hz/500 Hz)=16. Therefore, the T1 subset is the set of samples {16, 32, . . . , 144, 160}, the T2 subset is the set of samples {176, 192, . . . , 384, 400}.

Now, in order to synthesize a tone having a duration of 40 ms and pitch of 1000 Hz, then the synthesized waveform will have (8000 Hz*40 ms)=320 samples. For this waveform, there are 40 synthesis time-marks that include the set of samples Ts={8, 16, 24, 32, . . . , 312, 320}. Because the synthesis duration is smaller than the analysis duration, Type-A processing is applied. The synthetic music waveform period Is is extracted from the analysis waveform located at position index Ia where:

$$Ks=Ts/Ta \text{ here } Ta=16 \text{ and } Ts=8$$

$$Ks=0.5.$$

Therefore, for this example, the relationship between the synthesis period and the corresponding analysis period is:

$$Ia=Ks*Is$$

$$Ia=0.5\ *Is$$

In a second example, in order to synthesize a tone having a duration of 80 ms and pitch of 1000 Hz, then the synthesized waveform will have a Ds=(8000*0.080)=640 samples. For this waveform, there are 80 synthesis time-marks that include the set of samples Ts={8,16,24,32, . . . , 632, 640}. Because the synthesis duration is greater than the analysis duration, Type-A processing is applied on the Ta1 time-marks and Type-B processing is applied in Ta2 time-marks. The synthetic music waveform period Is is extracted for the analysis waveform located at position index Ia where:

$$Ks1=Ts/Ta \text{ here } Ta=16 \text{ and } Ts=8$$

$$Ia=Ks1*Is$$

$$Ia=0.5*Is \text{ for } Ia=0 \ldots Na1-1$$

and $$Ks2=(Ts*Da2)/(Ta*Ds2) \text{ here } Da2=30\ ms \text{ and } Ds2=60\ ms$$

$$Ia=Ks2*(Is-Na1/Ks1)$$

$$Ia=0.25*(Is-Na1/Ks1) \text{ for } Ia=Na1 \ldots Na2-1$$

Thus, synthesis periods Is {0 . . . 19} will be extracted from the analysis period Ia=0, . . . , 9 and corresponds to the synthesized samples {0, . . . 159}. Synthesis periods Is {20 . . . 79} will be extracted from the analysis periods Ia=10, . . . , 24 and corresponds to the synthesized samples {160, . . . , 639}.

Figure 4:
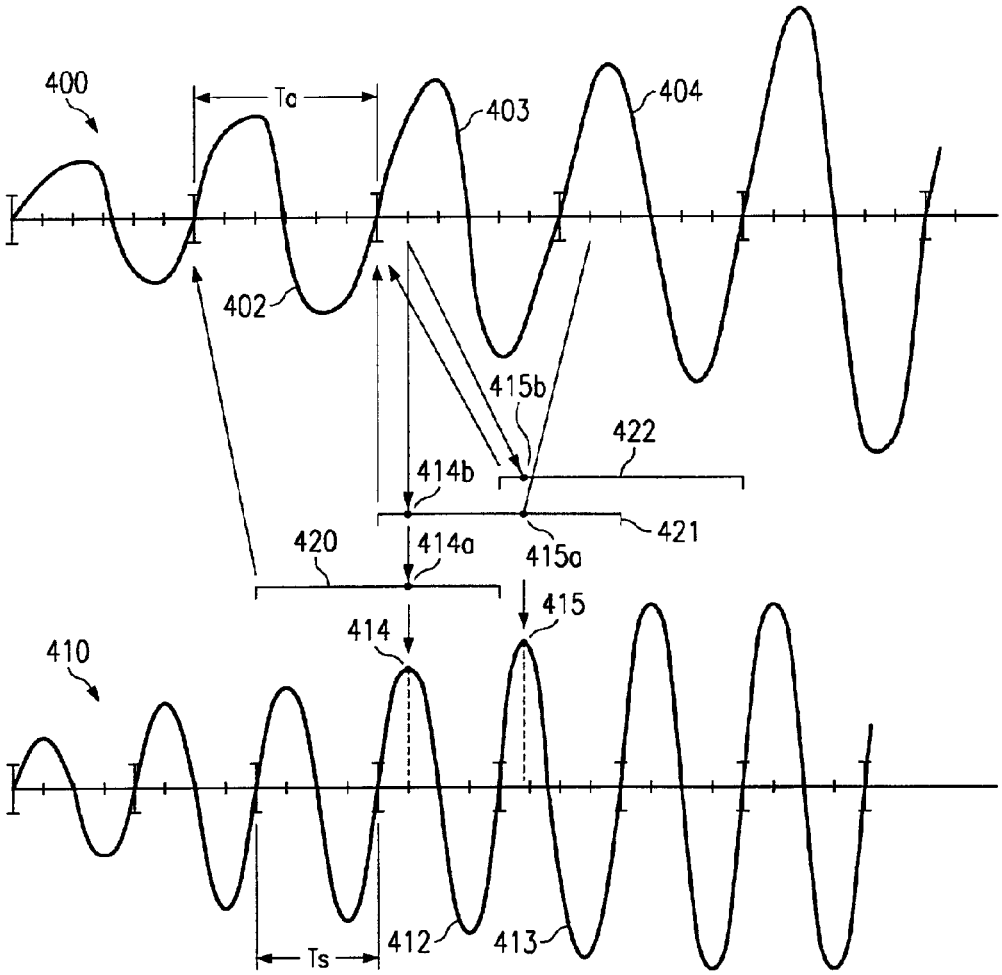
FIG. 4 is a an illustration of another embodiment of the invention illustrating the use of two windows to form a synthesized waveform.

FIG. 4 is an illustration of another embodiment of the invention illustrating the use of two windows to form a synthesized waveform 410. Each window is a Hanning window. A Hanning window is a cosinous digital manipulation of a sampled signal which forces the beginning and ending samples of the time record to zero amplitude. Other embodiments of the invention may use other known types of windows, such as Hamming, triangular, etc.

Representative windows 420–422 are shown for illustration; however, similar windows are applied continuously along the entire length of the synthesis waveform. For each time mark index position, a window is determined that is the minimum length of both the local period of analysis and synthesis around the local index [m].

$$\begin{aligned}\text{Window length} &= WL\\ &= \min(Time(Is[m+1]) - Time(Is[m-1]),\\ &\quad Time(Ia[m+1]) - Time(Ia[m-1]))\\ &\quad (\text{with } Ia[m] = \text{round}(KS*[m-1])\end{aligned}$$

This window length covers 2 periods: one before Ia[m] and one after Ia[m]. Function "time" gives the absolute position of the sample position in the wave files (analysis & synthesis) when the input is the synthesis period index. For example:

$$\text{Time}(Is[40])=1000$$

means that the $1000^{th}$ sample of synthesis corresponds to the 40th synthesis start of period.

Once the window length is determined, a function is called for computing, with embedded pre-computed tables, the Hanning window for the extraction of analysis samples. This function takes the window length as input and returns an array of data corresponding to the corresponding window length. For example, Win(18) returns a raised cosinous window of 18 samples.

Due to the possible large values of Ks, a smoothing operation is applied that uses an interpolation between two consecutive analysis extracted periods of samples before putting them on the synthesis time-scale. More precisely, the last period of analysis indexed from the previous ia index is used to smooth the current synthesis period. The two periods of analysis are weighted and summed before being put on the synthesis time scale. The weights are computed with the fractional part of the computation F=Is*Ks. The two weights applied on the two analysis periods are:

$$W1=(1.0-(Is*Ks-((\text{integer})(Is*Ks)))$$

$$W2=(Is*Ks-((\text{integer})(Is*Ks))$$

The computation uses the non-integer part of the product Is*Ks and is performed using masks and shifts. Ks is represented in Q9.6 format; a 16 bit integer is coded with the 9 MSB as integer part and the 6 LSB as fractional part. In another embodiment, other formats may be used, such as a floating-point representation, for example.

Thus, for a given synthesis sample, such as synthesis sample 414, a sample 414*a* extracted with window 420 from analysis periods 402–403 is weighted and combined with a weighted sample 414*b* extracted with window 421 from analysis periods 403–404.

As discussed earlier, due to time skew, the same analysis periods are occasionally reused. For example, for synthesis sample 415, a sample 415*a* extracted with window 421 from analysis periods 404–404 is weighted and combined with a weighted sample 415*b* extracted with window 422 from the same analysis periods 403–404.

This weighting feature is designed for the conditions where a small portion of an analysis signal is stored and a long synthesis signal is requested. Then the Ks value is very small (for example 0.03) and the weighting then corresponds to a smoothing factor instead of having long repetitions of the same analysis windows.

In another embodiment of the invention, interpolation can also be performed to compensate for the fact that generally the exact position of the synthesis period does not correspond to a sample boundary. The interpolation uses two extracted analysis windows. The positions of the synthesis periods are spaced from a time mark Ts that is not an integer; for example $$300 \text{ Hz} \Rightarrow Ts=8000/300=26.67.$$

In this example, the fractional part is:

$$FRAC(26.27*m)=0.333.$$

If m=50 and the two weights are ws1=(1–0.333) and ws2=(0.333), the synthesis samples are then computed as follows:

For (i=(−WL) up to (+WL)) do {

X1=W[i]*Analysis_signal[Time(Ia[m])+i]

X2=W[i]*Analysis_signal[Time(Ia[m])+i+1]

Synthesis_signal[Time(Is[m])+i]=ws1*X1+ws2*X2}

Advantageously, the total number of operations is only four multiplies and one addition per synthesis sample for the interpolation. When the interpolated samples are weighted and combined as shown in FIG. 4, then the total number of operations per final synthesis sample is doubled but still modest: eight multiplies and two additions.

In another embodiment, an additional step is performed to improve a synthesized waveform that performs a time-reversal operation on selected periods. A pseudo-random number generator is used to decide if the current time-mark period is to be swapped. The first sample of the period to be copied to the synthesis time scale is referred to as A[tm_ia], and tsa is the number of samples extracted from analysis. If the current computed period index Ia is identical to the previous computed one for the last synthesis period due to time skew as described above, then time-reversal is considered. If the random number generator gives an even value the samples are copied with the respect of the time sequence, that is, the first sample is A[tm_ia] and the last one is A[tm_ia+tsa−1]. Otherwise, if the random data is odd the time sequence is inverted, such that the first synthesis data is A[tm_ia+tsa−1] and the last one is A[tm_ia].

Figure 5:
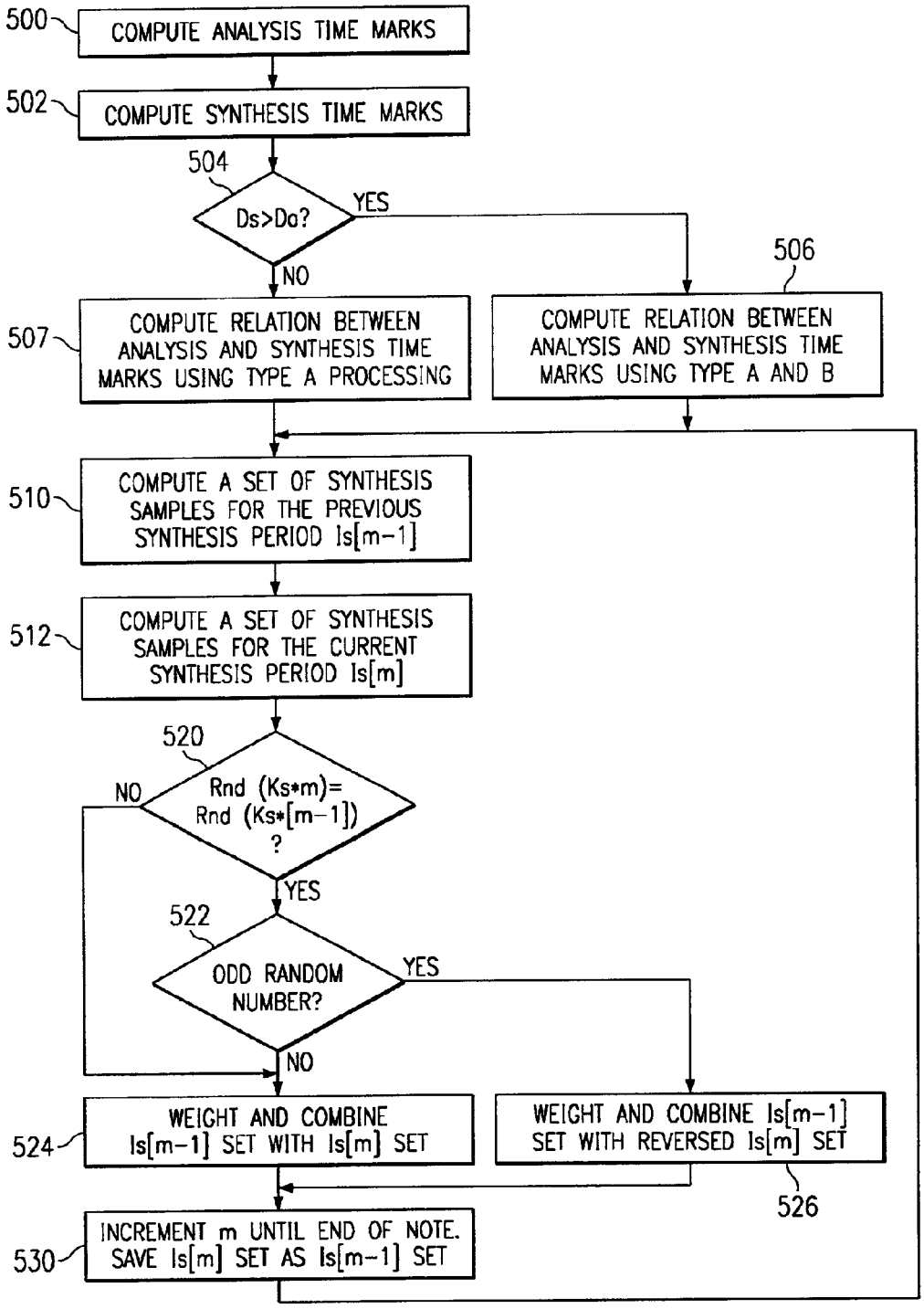
FIG. 5 is a flow chart illustrating steps for synthesizing a note according to aspects of the present invention.

FIG. 5 is a flow chart summarizing the steps for synthesizing a note, according to aspects of the present invention, as described above. In step 500, recordings of the various instruments are made, they are each analyzed, and a set of analysis time marks is computed. The annotated analysis waveforms are then stored.

In step 502, a selected note or a melody is received, typically in the form of a melody file, which is to be synthesized. A file format for this step will be described in more detail later. For each note, a set of synthesis time marks is calculated. The following steps are performed for each note. If more than one note is to be played in parallel, then the following steps are performed for each note within a time frame to allow parallel play.

In step 504, for each note an annotated analysis waveform is accessed as defined by the melody file. A relationship between the set of analysis time marks and the set of synthesis time marks is then computed according to the duration of each. If Ds>Da, then type A processing will be used on the attack portion and type B processing will be used on the decay portion (step 506). If Ds=>Da, then type A processing will by used on the entire synthesis waveform (step 507). Coefficient Ks is calculated for type A processing, while coefficients Ks1 and Ks2 are calculated for type B processing.

Step 510 is part of an iteration loop that incrementally computes each period of the synthesized waveform. This loop is traversed for each period of the synthesized waveform using an index m that is initialized to zero. During each iteration of this step, a set of synthesis samples is computed for the synthesis period Is[m−1]. Previous synthesis period Is[m−1] is computed from analysis period Ia=round(Ks*[m−1]) using the cosinous Hanning window described previously. As described previously, if the duration of the synthesis waveform is less than or equal to the duration of the analysis waveform, then type A processing is used on all of the synthesis periods. However, if Ds>Da, then type A processing is used for synthesis periods within the attack portion and type B processing is used for synthesis periods within the decay portion.

Likewise, during each iteration of step 512, a set of synthesis samples is computed for the synthesis period Is[m]. Type A processing and type B processing is performed in accordance with the relative durations of the synthesis and analysis waveforms.

In an embodiment that includes processing to compensate for the fact that generally the exact position of the synthesis period does not correspond to a sample boundary, as described above, an interpolation calculation is included in step 510 to compute synthesis period Is[m−1] and in step 512 to compute synthesis period Is[m].

Step 520 determines if time reversal should be considered for this iteration. If, in step 512, round(Ks*m)=round(Ks*[m−1]), then a random reversal of the synthesized samples within the current period Is[m] is invoked. The random reversal is based on a pseudo random number generator that is tested in step 522. If the random number is odd, then time reverse the Is[m] set of samples, otherwise do not perform a time reverse.

In step 524, if no time reversal is to be done, then each sample of previous the synthesis period Is[m−1] is weighted by weighting factor W1, where W1=(1.0−([m]*Ks−((int)([m]*Ks))). Each sample of the current synthesis period Is[m] is weighted by weighting factor W2, where W2=([m]*Ks−((int)([m]*Ks))). The results are added together sample-wise to form a final version of current synthesis period Is[m] and then added to the time scale.

For example: if Ks=0.3, m=454, then $$W1 = (1.0 - ((454 * 0.3) - \text{int}(454 * 0.3)) = 0.8$$

$$W2 = (454 * 0.3) - \text{int}(454 * 0.3) = 0.2$$

If a time reversal is to be done, then step 526 is performed instead of 524. Weighting is performed the same as for step 524; however, the set of samples for the current synthesis period from step 512 are time reversed prior to combining with the samples from the previous synthesis period from step 510.

Step 530 is the end of the iterative loop. Index m for Is is incremented by one and the loop beginning with step 510 is repeated until the final synthesis period of the note is reached. The sample set Is[m] that was calculated in step 512 is saved and is used as the "previous synthesis period" for the next pass through the loop so that no additional calculations need be performed in step 510.

FIG. 6A is a flow diagram illustrating how a set of analysis waveforms are collected. In step 600, a single note from an instrument is sampled to form an instrumentally correct digital analysis waveform. The sampling rate is selected according to the expected use. For telephone type devices, a sampling rate of 8 kHz is typically used. For a high quality audio synthesizer, a sample rate of 40 khz might be used, for example.

In step 602, the sampled digital waveform is analyzed to determine the duration of an attack portion and the duration of a decay portion. In the present embodiment, this characterization is performed by displaying the sampled waveform on video display device and visually selecting a time point at which the attack portion is complete. Another embodiment may automate this step using a waveform analysis filter, for example.

A set of timing marks is also calculated during step 602 that corresponds to the period boundaries of the analysis waveform. For a non-periodic waveform, timing marks can be assigned at regular intervals. A set of timing marks T1 is computed for the attack portion and a set of timing marks T2 is computed for the decay portion.

The digital waveform and the duration information and the two sets of timing marks are then stored in a file as an annotated analysis waveform for later use. Step 604 initiates a repeat of steps 600 and 602 for another set of instruments if desired.

FIG. 6B is an illustration of an orchestra file that includes a set of analysis waveforms for several different instruments. Each entry in the orchestra file is an annotated analysis waveform, as described above, that includes a digitized analysis waveform, duration information and timing marks. The synthesis method described herein can produce good quality synthesized notes over a range of three to five octaves for some types of instruments. Typically, a wide range of instruments can be synthesized using these techniques over a range of approximately +/−one octave from the analysis waveform. Therefore, for a telephone type device that has a bandwidth of approximately 4 kHz, only two analysis samples are required for each instrument, at 500 Hz and at 2000 Hz. For instrument types that may not normally produce a broad range of notes, only a single sample may suffice, such as for a bass 620 that does not produce higher notes or for a flute 622 that does not produce lower notes.

Advantageously, a wide range of instruments can be represented in an orchestra file in a relatively small amount of memory.

Figure 7:
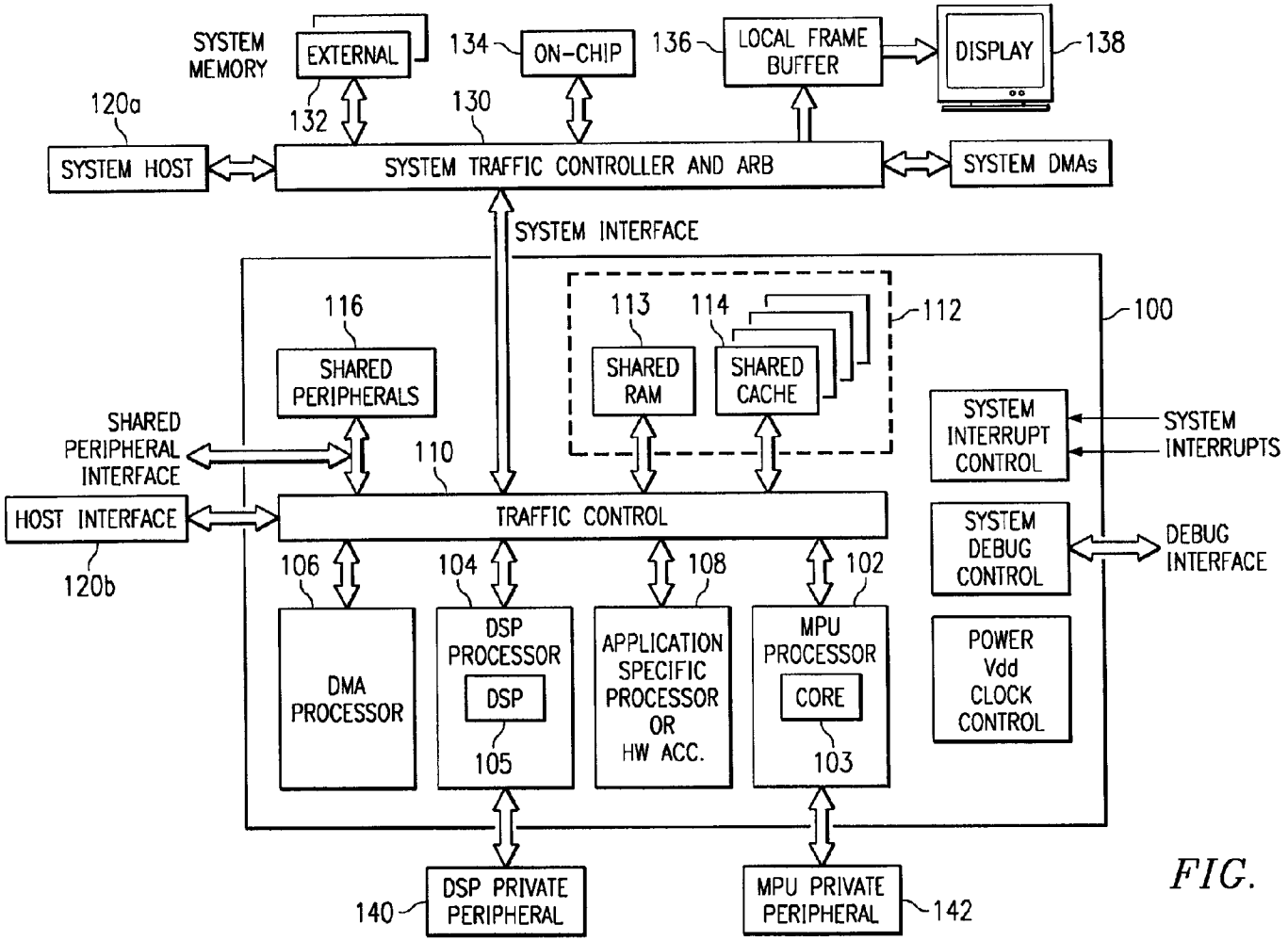
FIG. 7 is a block diagram of a digital system that includes an embodiment of the present invention in a megacell core having multiple processor cores.

FIG. 7 is a block diagram of a digital system that includes an embodiment of the present invention in a megacell core 100 having multiple processor cores. In the interest of clarity, FIG. 1 only shows those portions of megacell 100 that are relevant to an understanding of an embodiment of the present invention. Details of general construction for DSPs are well known, and may be found readily elsewhere. For example, U.S. Pat. No. 5,072,418 issued to Frederick Boutaud, et al, describes a DSP in detail. U.S. Pat. No. 5,329,471 issued to Gary Swoboda, et al, describes in detail how to test and emulate a DSP. Details of portions of megacell 100 relevant to an embodiment of the present invention are explained in sufficient detail herein below, so as to enable one of ordinary skill in the microprocessor art to make and use the invention.

Referring again to FIG. 7, megacell 100 includes a control processor (MPU) 102 with a 32-bit core 103 and a digital signal processor (DSP) 104 with a DSP core 105 that share a block of memory 113 and a cache 114, that are referred to as a level two (L2) memory subsystem 112. A traffic control block 110 receives transfer requests from a host processor connected to host interface 120*b*, requests from control processor 102, and transfer requests from a memory access node in DSP 104. The traffic control block interleaves these requests and presents them to the shared memory and cache. Shared peripherals 116 are also accessed via the traffic control block. A direct memory access controller 106 can transfer data between an external source such as off-chip memory 132 or on-chip memory 134 and the shared memory. Various application specific processors or hardware accelerators 108 can also be included within the megacell as required for various applications and interact with the DSP and MPU via the traffic control block.

External to the megacell, a level three (L3) control block 130 is connected to receive memory requests from internal traffic control block 110 in response to explicit requests from the DSP or MPU, or from misses in shared cache 114. Off chip external memory 132 and/or on-chip memory 134 is connected to system traffic controller 130; these are referred to as L3 memory subsystems. A frame buffer 136 and a display device 138 are connected to the system traffic controller to receive data for displaying graphical images. A host processor 120*a* interacts with the external resources through system traffic controller 130. A host interface connected to traffic controller 130 allows access by host 120*a* to external memories and other devices connected to traffic controller 130. Thus, a host processor can be connected at level three or at level two in various embodiments. A set of private peripherals 140 are connected to the DSP, while another set of private peripherals 142 are connected to the MPU.

Although the invention finds particular application to Digital Signal Processors (DSPs), implemented, for example, in an Application Specific Integrated Circuit (ASIC), it also finds application to other forms of processors. An ASIC may contain one or more megacells which each include custom designed functional circuits combined with pre-designed functional circuits provided by a design library.

FIG. 8 is a flow chart illustrating synthesis of a melody on the digital system of FIG. 7 according to an aspect of the present invention. Software executing on MPU 102 responds to a user request or other stimuli to select a melody for synthesis. In step 800, MPU 102 loads the analysis waveforms and analysis time marks into shared memory 112. If the request is for just a single instrument, then only the annotated analysis waveforms for the selected instrument are loaded. For a more complex melody, an entire orchestra file is loaded. The orchestra file is maintained in the L3 memory subsystem.

In step 802, MPU 102 loads a file that contains a requested musical score into shared memory 112. A musical score file is referred to herein as an E2 file.

The E2 file format is a compressed binary file in order to use as least possible memory in the MPU address space. The data rate is about 4 bytes per synthesized note. This size can be greater with optional sound generation effects like: pitch bend, volume tremolo and vibrato.

The E2 file format, for each note there is an 8-bit data byte indicating two things: the first seven bits is a time stamp indicating the time interval in 20 ms periods before loading the current note event; and the eighth bit is an indicator of an extended format for the following data.

The time stamp byte is followed by two bytes (16 bits) of note definition data having the following format: six bits for frequency selection, three bits for amplitude, three bits for the analysis wave selection, and four bits for the duration.

If the extended format bit is set then these two bytes are followed by four additional bytes used for sound effects control.

The MCU reads the first byte of the data stream, then waits a time period according to the time stamp before loading the dual port memory interface with the note definition data: two bytes or six bytes if the extension bit is set. Then the MCU reads the next time stamp byte indicating a delay for the next note before loading the next set of note definition data. For notes to be played in parallel, the time delay could be zero.

In step 804, DSP 104 reads each set of note definition data provided by the MPU from the E2 file and computes the frequency, amplitude, and duration of each note to synthesize using the respective fields in the two byte note definition data. DSP 104 then computes a set of synthesis time marks for each note.

In step 806, the DSP computes the relation between the analysis and synthesis time marks, as described previously, by selecting an analysis waveform of an instrument type specified by the three bit wave selection field in the note definition data. Where there is more than one analysis waveform for the specified instrument, selection is further based on selecting an analysis waveform whose frequency is closest to the frequency specified for the synthesized note.

In step 808, the DSP computes the synthesis samples for the requested note and applies sample weighting and sample time reversal to improve the quality of the synthesized note, as described previously with reference to FIG. 5. The synthesized samples are then written to an audio conversion interface for playing. The audio conversion interface is included in the set of peripherals 140 that are connected to the DSP.

In step 810, a check is made to see if the last note definition data has been received from the MPU. If another note request is pending, the loop is repeated using the new note definition data.

Advantageously, since the synthesized notes are played in real time as they are generated, only a vanishingly small buffer area is required to support the synthesis operation.

Digital System Embodiment

Figure 9:
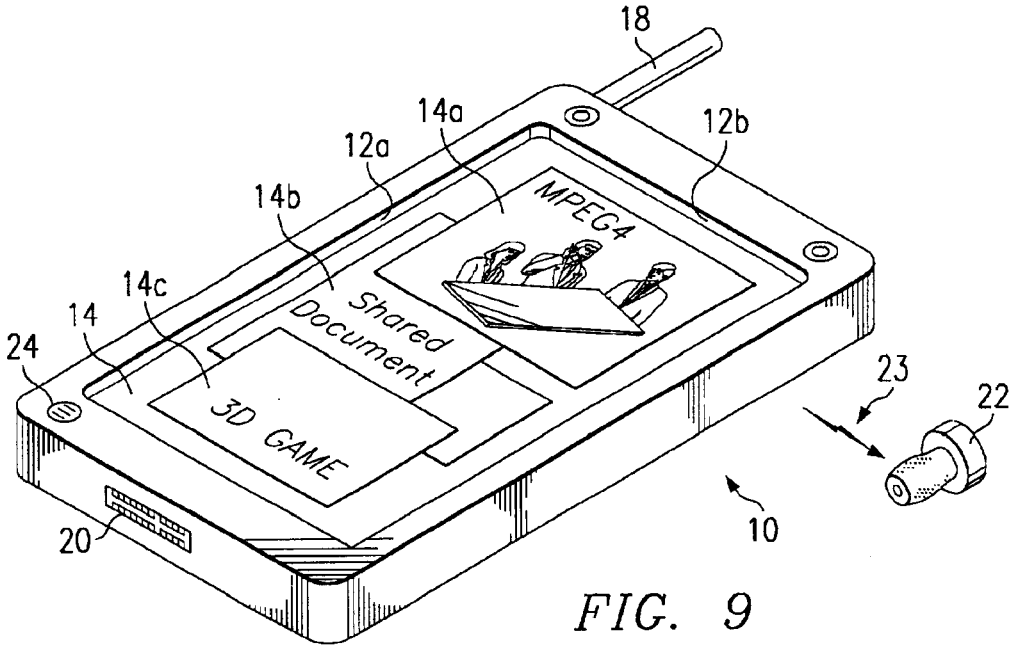
FIG. 9 is a representation of a wireless telecommunications device incorporating an embodiment of the present invention.

FIG. 9 illustrates an exemplary implementation of the invention in a mobile telecommunications device, such as a mobile personal digital assistant (PDA) 10 with display 14 and integrated input sensors 12*a*, 12*b* located in the periphery of display 14. As shown in FIG. 9, digital system 10 includes a megacell 100 according to FIG. 1 that is connected to the input sensors 12*a,b* via an adapter (not shown), as an MPU private peripheral 142. A stylus or finger can be used to input information to the PDA via input sensors 12*a,b*. Display 14 is connected to megacell 100 via local frame buffer similar to frame buffer 136. Display 14 provides graphical and video output in overlapping windows, such as MPEG video window 14*a*, shared text document window 14*b* and three dimensional game window 14*c*, for example.

Radio frequency (RF) circuitry (not shown) is connected to an aerial 18 and is driven by megacell 100 as a DSP private peripheral 140 and provides a wireless network link. Connector 20 is connected to a cable adaptor-modem (not shown) and thence to megacell 100 as a DSP private peripheral 140 provides a wired network link for use during stationary usage in an office environment, for example. A short distance wireless link 23 is also "connected" to earpiece 22 and is driven by a low power transmitter (not shown) connected to megacell 100 as a DSP private peripheral 140. Microphone 24 is similarly connected to megacell 100 such that two-way audio information can be exchanged with other users on the wireless or wired network using microphone 24 and wireless earpiece 22.

Megacell 100 provides all encoding and decoding for audio and video/graphical information being sent and received via the wireless network link and/or the wire-based network link.

A synthesized melody that is written by the DSP to an audio conversion interface can be listened to via wireless earpiece 22. Similarly, a speaker or a set of speakers can be connected to the audio conversion interface and thereby play the synthesized melody.

It is contemplated, of course, that many other types of communications systems and computer systems may also benefit from the present invention, particularly those relying on battery power. Examples of such other computer systems include portable computers, smart phones, web phones, and the like. As power dissipation and processing performance is also of concern in desktop and line-powered computer systems and micro-controller applications, particularly from a reliability standpoint, it is also contemplated that the present invention may also provide benefits to such line-powered systems.

This music synthesis technique can be applied to many different kinds of applications. For example, for various types of electronic musical instruments, one analysis wave is recorded for each musical octave scale. Advantageously, the algorithm plays all the twelve half-tones of the scale.

Another embodiment can be used in electronic games to play the music used in games. Advantageously, memory requirements and processor resources are minimized by the algorithm described herein.

In another embodiment, cellular and fixed-line phone will use this technique in for playing pre-selected or customized ringing melodies.

As used herein, the terms "applied," "connected," and "connection" mean electrically connected, including where additional elements may be in the electrical connection path. "Associated" means a controlling relationship, such as a memory resource that is controlled by an associated port. The terms assert, assertion, de-assert, de-assertion, negate and negation are used to avoid confusion when dealing with a mixture of active high and active low signals. Assert and assertion are used to indicate that a signal is rendered active, or logically true. De-assert, de-assertion, negate, and negation are used to indicate that a signal is rendered inactive, or logically false.

While the invention has been described with reference to illustrative embodiments, this description is not intended to be construed in a limiting sense. Various other embodiments of the invention will be apparent to persons skilled in the art upon reference to this description.

It is therefore contemplated that the appended claims will cover any such modifications of the embodiments as fall within the true scope and spirit of the invention.

What is claimed is:

1. A method of synthesizing music in a digital system, comprising the steps of:

accessing a digital analysis waveform having a first duration, a first pitch, a first attack portion arid a first decay portion;

determining a second duration and a second pitch for a synthesis waveform;

computing first timing marks for the analysis waveform such that the first timing marks correspond to periodicity of the analysis waveform;

computing second timing marks for the synthesis waveform such that the second timing marks correspond to periodicity of the synthesis waveform;

calculating samples for each period of the synthesis waveform defined by adjacent second timing marks using samples selected from a corresponding period of the analysis waveform defined by adjacent first timing marks to form the synthesis waveform having the second pitch, the second duration, a second attack portion and a second decay portion; and wherein the step of calculating samples to form the synthesis waveform includes determining whether the duration of the synthesis waveform is greater than the duration of the analysis waveform, if the duration of the synthesis waveform is greater than the duration of the analysis waveform synthesizing the second attack portion by pitch modification of the analysis waveform and the synthesizing the second decay portion by pitch modification and duration extension, and if the duration of the synthesis waveform is not greater than the duration of the analysis waveform synthesizing both the second attack portion and the second decay portion by pitch modification.

2. The method according to claim 1, wherein:

said step of synthesizing the second attack portion by pitch modification of the analysis waveform if the duration of the synthesis waveform is greater than the duration of the analysis waveform and said step of synthesizing both the second attach portion and the second decay portion by pitch modification if the duration of the synthesis waveform is not greater than the duration of the analysis waveform employs the equation:

$$Ia=Is*Ks1$$

where: Ia is the analysis time mark index having a range from 0 to Na−1; Is is the synthesis time mark index having a range from 0 to Ns−1; and Ks1 is a fraction factor equal to Ts/Ta, where Ta is the duration of the synthesis waveform and Ta is the duration of the analysis waveform; and said step of synthesizing the second decay portion if the duration of the synthesis waveform is greater than the duration of the analysis waveform employs the equation:

$$Ia=Is*Ks2$$

where: Ks2 is a fraction factor equal to (Ts*Da2)/(Ta*Ds2), where Da2 is the duration of the decay portion of the analysis waveform and Ds2 is the duration of the decay portion of the synthesis waveform.

3. A method of synthesizing music in a digital system, comprising the steps of:

accessing a digital analysis waveform having a first duration, a first pitch, a first attack portion and a first decay portion;

determining a second duration and a second pitch for a synthesis waveform;

computing first timing marks for the analysis waveform such that the first timing marks correspond to periodicity of the analysis waveform;

computing second timing marks for the synthesis waveform such that the second timing marks correspond to periodicity of the synthesis waveform; and calculating samples for each period of the synthesis waveform defined by adjacent second timing marks using samples selected from a corresponding period of the analysis waveform defined by adjacent first timing marks to form the synthesis waveform having the second pitch, the second duration, a second attack portion and a second decay portion, step of calculating samples for each period further comprising the steps of:

calculating a set of samples for a period m using a first cosinous window, calculating a set of samples for a m−1 using a second cosinous window, combining the set of samples for period m and the set of samples for period m−1 using a weighting function, and wherein the first cosinous window operates on two adjacent periods and the second cosinous window operates on two adjacent periods shifted by one period from the first cosinous window.

4. The method according to claim 3, further comprising the step of reversing a selected one of the set of samples before the step of combining the sets of samples.

5. The method according to claim 4, wherein the step of reversing is performed only when two consecutive periods of the synthesis waveform are formed using same periods of the analysis waveform; and wherein the step of reversing is responsive to a random number generator.

6. A method of synthesizing music in a digital system, comprising the steps of:

accessing a digital analysis waveform having a first duration, a first pitch, a first attack portion and a first decay portion, said first attack portion corresponding to where said waveform builds up to crescendo and then subsides;

determining a second duration and a second pitch for a synthesis waveform;

computing first timing marks for the analysis waveform such that the first timing marks correspond to periodicity of the analysis waveform;

computing second timing marks for the synthesis waveform such that the second timing marks correspond to periodicity of the synthesis waveform;

calculating samples for each period of the synthesis waveform defined by adjacent second timing marks using samples selected from a corresponding period of the analysis waveform defined by adjacent first timing marks to form the synthesis waveform having the second pitch, the second duration, a second attack portion and a second decay portion; and wherein the step of calculating samples forms the synthesis waveform such that the second attack portion has a duration approximately equal to a duration of the first attack portion.

* * * * *